US006059052A

United States Patent [19]

Haggard

[11] Patent Number: 6,059,052

[45] Date of Patent: May 9, 2000

[54] EXTERNAL PIPE WIPING APPARATUS AND METHOD OF PULLING AND WIPING A PIPE STRING

[76] Inventor: Archie Haggard, 4718 Hallmark, Houston, Tex.

[21] Appl. No.: 08/999,058

[22] Filed: Dec. 22, 1997

Related U.S. Application Data

[63] Continuation-in-part of application No. 08/730,476, Oct. 16, 1996, abandoned.

[51] Int. Cl.[7] ..... E21B 33/08

[52] U.S. Cl. ..... 175/84; 15/220.4; 166/82.1

[58] Field of Search ..... 15/220.4; 175/84; 166/81.1, 82.1, 83.1

[56] References Cited

U.S. PATENT DOCUMENTS

| | | | |
|---|---|---|---|
| 2,264,600 | 12/1941 | Webb | 15/220.4 |
| 2,718,021 | 9/1955 | Baebel | 15/102 |
| 2,809,012 | 10/1957 | Stevens | 15/220.4 |
| 2,850,754 | 9/1958 | Davis | 15/220.4 |
| 3,733,641 | 5/1973 | Brown | 15/210 B |
| 4,399,869 | 8/1983 | Bentley | 166/311 |
| 4,457,366 | 7/1984 | Brown | 166/82 |
| 4,860,826 | 8/1989 | Land | 166/80 |
| 4,982,787 | 1/1991 | Reddoch | 166/82 |
| 5,101,896 | 4/1992 | Thompson et al. | 166/90 |
| 5,842,252 | 12/1998 | Cameron et al. | 15/256.5 |

*Primary Examiner*—Eileen Dunn Lillis
*Assistant Examiner*—Chong S. Cho
*Attorney, Agent, or Firm*—Gunn & Associates, P.C.

[57] ABSTRACT

This device is a pipe wiping apparatus. The pipe wiping structure incorporates a housing and the housing is provided with a central opening to enable the housing to be positioned along the pathway of a pipe string. The pipe string is extended upwardly and passes through the housing. The pipe string is made of a number of drill pipes which are serially connected to extend through the housing so that the external surface can be wiped. As the pipe string passes through the housing, it is exposed to the action of similar wipers which are mounted on multiple actuators where each actuator incorporates a low pressure pneumatic cylinder. The cylinder operates a piston which moves a piston rod which operates a belt crank. This belt crank mechanism rotates an arm to thereby rotate a curving conformed resilient wiper element of sheet material. It is supported on the arm extending radially inwardly toward the pipe. Retraction is permitted to pull the wiper away from the pipe. Each wiper element can move radially toward the pipe to accommodate external upsets in the pipe string.

30 Claims, 7 Drawing Sheets

EXTERNAL PIPE WIPING APPARATUS AND METHOD OF PULLING AND WIPING A PIPE STRING

BACKGROUND OF THE DISCLOSURE

This is a continuation-in-part application of Ser. No. 08/730,476 having a filing date of Oct. 16, 1996, now abandoned.

This disclosure is directed to an external pipe wiping apparatus. It is a device which is used in drilling an oil well with drilling fluid. The drilling fluid is typically made of water and clay, and is, therefore, often called drilling mud. Sometimes, it is even made with oil additives, some of which additives are extremely expensive. While the mud and additives are not only expensive, they also pose a number of problems when spilled near or around the drilling rig. At best, work on the rig floor is dangerous, but it is especially dangerous at the time of pulling a drill string. This is typically described as making a trip. It is necessary to make a trip when the drill bit is worn. When the drill bit becomes worn, drilling is slowed and the bit must, therefore, be replaced. It is not uncommon to pull the drill pipe from the partially drilled well by removing the drill pipe, raising the pipe string in the derrick and unthreading the pipe. While the pipe is normally made in 30' lengths, it is often unthreaded to reduce the handling by standing three joints of pipe in the derrick. They are pushed to the side after unthreading from the drill string. As each stand of pipe is pulled above the rig floor, it will drip on the rig floor. As it drips, the rough necks on the rig floor have the risk of slipping and falling. More than that, the drilling mud on the floor poses a hazard should it simply wash over the side of the rig. Whether on land or in offshore waters, the drilling fluid needs to be contained.

Various and sundry wiping devices have been used in the past. The present disclosure is directed to an external pipe wiping device which enables pipe wiping to be done in a regular systematic way. Moreover, it is a device which reduces significantly the amount of drilling fluid clinging to the outer wall of the drill pipe. When pulling 100 stands of pipe from a 9,000' well, a substantial amount of drilling mud can cling to the pipe and run down the side of the pipe. Without wiping, the rig floor can become quite dangerous.

The present disclosure is a device which is installed under the rig floor. It is relatively light weight. More than that, it is a device which can be installed under the rig floor and operated automatically so that it wipes the pipe on tripping the pipe out of the well. One aspect of this operation is the fact that the pipe has external upsets on it. The most common type of drill pipe is constructed with a pin and box connection which is accomplished at an enlargement. This protrudes to the exterior. This causes something of a problem as the pipe is moved upwardly. The present apparatus is well able to wipe the exterior of the pipe even with the external upsets on it. For that reason, the pipe wiping mechanism of the present disclosure mounts a set of wipers so that they are readily able to deflect, thereby permitting the upsets to pass through the equipment, and yet continue wiping the external surface.

The wiping element of the present disclosure is a relatively small resilient member. It is implemented by installation at spaced locations around the pipe. In the optimum construction, four similar devices are installed so that wiping elements are extended toward the pipe and contact against the pipe. They are, however, mounted on a pivot to swing between two positions. One position is retracted and the other extends the wiper element to contact the side of the pipe. When extended, the contact of each individual wiping element is less than the whole of the circle, but there are preferably four such units which overlap, and collectively they wipe the entire exterior. This is done, however, with extended wiping members which are positioned so that continual progression of the pipe from the well is permitted. When an upset passes through the equipment, the wipers are simply deflected.

The present invention utilizes a replicated system featuring a pivot connection for a cam actuated mechanism extending the wiper element from the retracted to the extended position. This is done by pneumatic cylinder. When air is applied at a relatively low pressure, the wiping element is extended. When air pressure is applied to the opposite piston face, pressure causes the wiper to retract. The device is summarized as incorporating four similar actuator units which are mounted in pairs on opposite sides of the pipe. This defines a relatively small and light weight structure having actuator units located at 90° intervals around the circle. This is supported in a streamlined housing to reduce the diameter or size of the housing. One construction is an octagon although a cylindrical container will also suffice. The actuator units are arranged to permit passage of the drill string along the centerline axis of the housing. Since the fur modular units are identical, each is provided with its own pneumatically operated cylinder which extends the wiping element. Return pressure or a spring pulls the wiping element to the retracted or withdrawn position. A bell crank cooperates with a mounting bracket which serves as a pivot. The wiping element is ideally mounted on an extending shaft pivotally mounted to permit deflection to the left or right so that the pipe can be tracked even when it is no longer coincident with the centerline axis of the equipment. Lateral movements necessary to achieve tracking are minimal and are sufficient to follow any crooked pipe. Even when a change of diameter occurs at external upsets, deflection is readily accommodated so that larger or smaller diameters can be wiped with one set of wiping elements. Typically, the equipment of the present disclosure is spaced just above the blowout preventer (BOP) which normally is positioned just over a bell nipple. The equipment can be supported just above the bell nipple where it is installed with a pneumatic sealing mechanism as will be described.

In field use, pipe is, in actuality, bent, crooked and otherwise irregular within a fairly large range. Such difficulties create problems with the mechanism extending the wiper elements. Not only must they extend towards a centerline position engaging an arc of the outside surface of the pipe, but they must flex to the right and left. On flexure, this enables each individual wiper to continue wiping an approximately 90° interval of the circle of the outer wall of the pipe. In actuality, they overlap somewhat so that each one wipes perhaps 90° to 100° of the circle. The four actuator units for the four wipers are mounted so that they provide pivotal rotation brining the individual wiper elements into proper engagement. This pivotal rotation must be modified so that each wiper element is brought into contact no matter how much flexure occurs in the particular wiper. With each pivotally mounted wiper, there is a range of movement permitted to accommodate the flexure.

BRIEF DESCRIPTION OF THE DRAWING

So that the manner in which the above recited features, advantages and objects of the present invention are attained and can be understood in detail, more particular description of the invention, briefly summarized above, may be had by reference to the embodiments thereof which are illustrated in the appended drawing.

It is to be noted, however, that the appended drawing illustrates only typical embodiments of this invention and is, therefore, not to be considered limiting of its scope, for the invention may admit to other equally effective embodiments.

DETAILED DESCRIPTION OF THE PREFERRED EMBODIMENT

Figure 1:
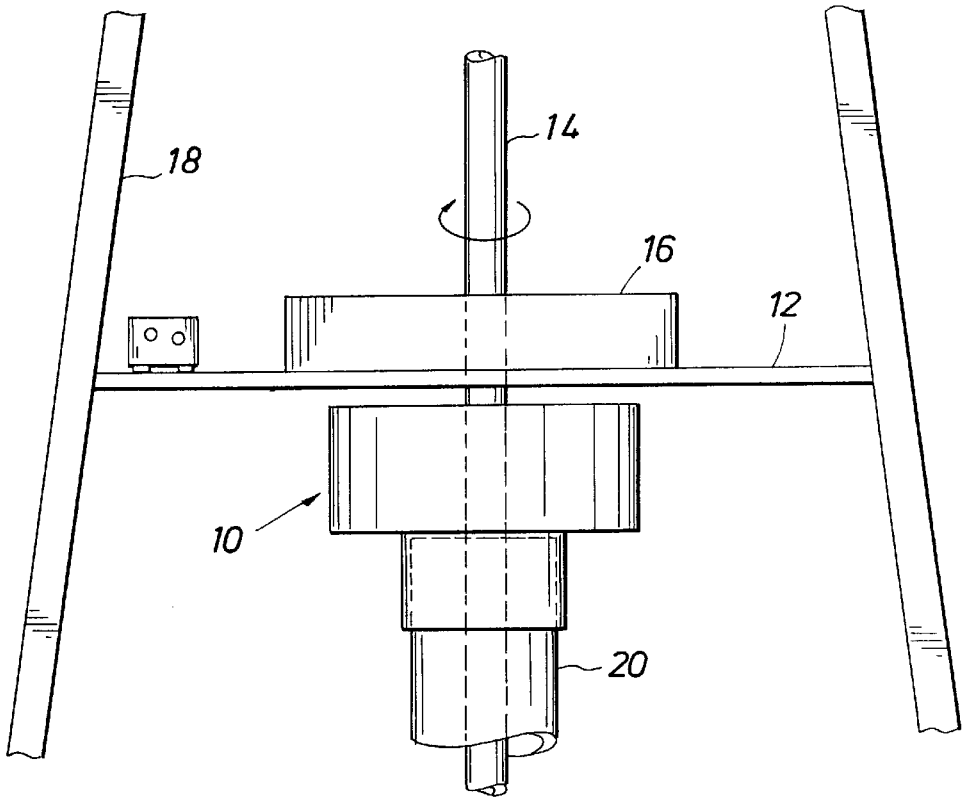
FIG. 1 shows the pipe wiping apparatus of the present disclosure installed on a drilling rig where it is located below the rig floor and just above a bell nipple.
Figure 9:
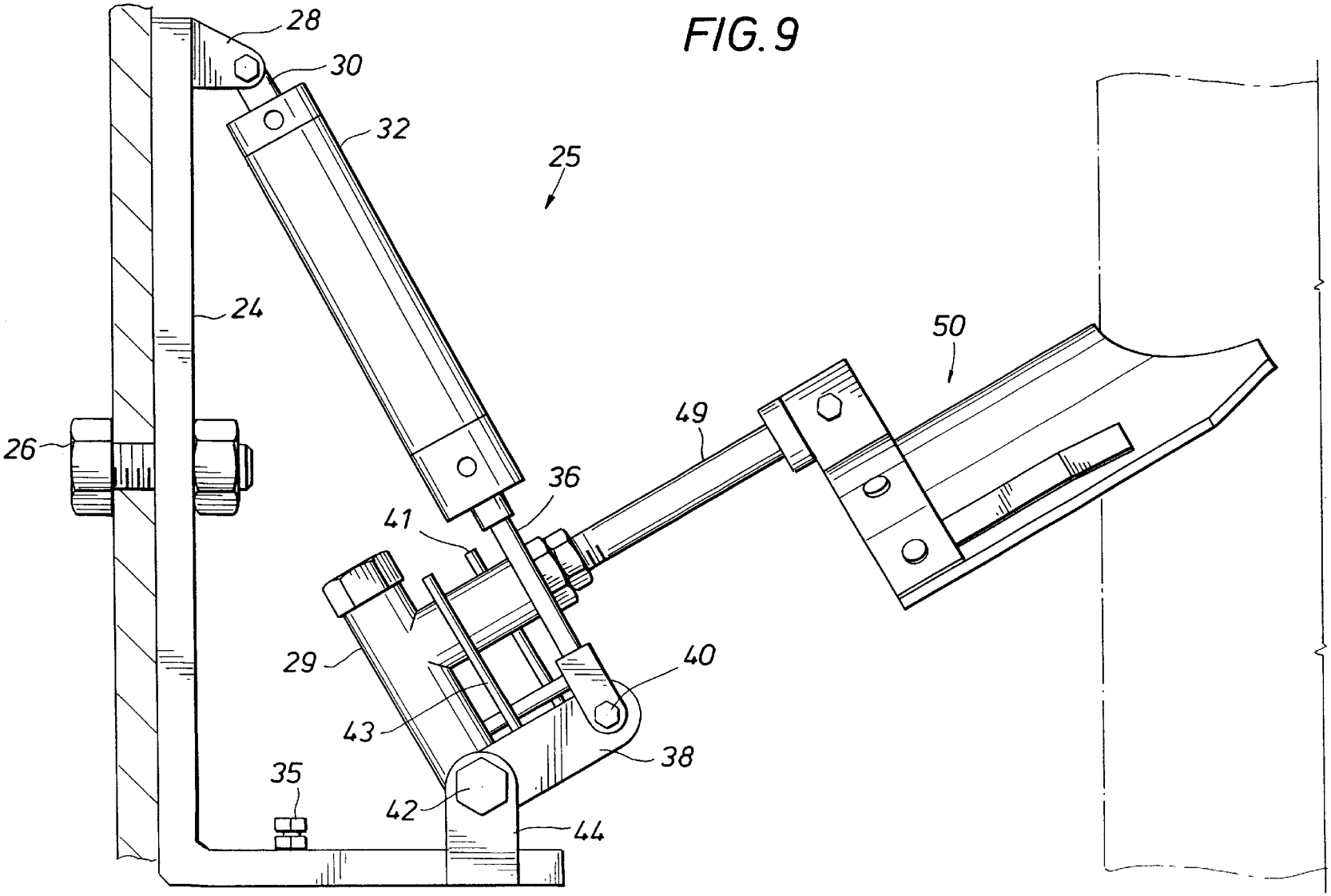
FIG. 9 is a view of the wiper mechanism shown in FIG. 2 in an extended pipe wiping position showing elongation of the equipment to reach the pipe.

Attention is first directed to FIG. 1 of the drawings which will be described very briefly to set forth the context of the present invention. The pipe wiping apparatus of this disclosure is identified generally by the numeral 10. It is a preferably octagonal or circular housing which is installed under a rig floor 12 and is located on the centerline of the rig equipment. A drill pipe 14 is rotated thereabove. The drill pipe extends through a rotary table 16. Rotation is imparted from an overhead draw works and Kelly (not shown) which support the drill pipe for rotation in the rotary table 16. The overhead equipment is suspended in the derrick 18. Under the rig floor, there is a BOP stack (omitted for sake of clarity) and that is connected to control mud flow return in the annular space on the exterior of the drill pipe 14. The BOP stack typically is connected with an upstanding conductor pipe. The conductor pipe directs the annular flow of mud upwardly which is finally delivered back for recirculation. FIG. 1 also includes a bell nipple 20 which is located under the rig floor. Drilling mud is delivered from the annular space in the well up into the bell nipple 20. FIG. 1 shows the bell nipple with the typical funnel at the top end. This wiping apparatus 10 is positioned on the bell nipple and rests on it after the funnel is trimmed square at the top end; FIG. 9 shows one mode of connection to assure easy mounting.

The apparatus of the present disclosure is enclosed in a housing which is not relatively thick. Typically, it can stand about 8 to 16" tall, and has a diameter or width of about 30 to 36". The size of the equipment is tailored to a set of pipe diameters; typically, one size of equipment will suffice for a range of pipe sizes. Changes in pipe size are normally accommodated without change of equipment but, in the event of very large changes in pipe size, the wiper elements are changed to handle different pipe sizes. This will be explained in some detail later. Suffice it to say, the pipe wiping apparatus 10 is installed as close to the bell nipple 20 as possible to deflect dripping mud so that it does not fall on the rig floor 12. It is dripped back into the bell nipple 20.

Figure 2:
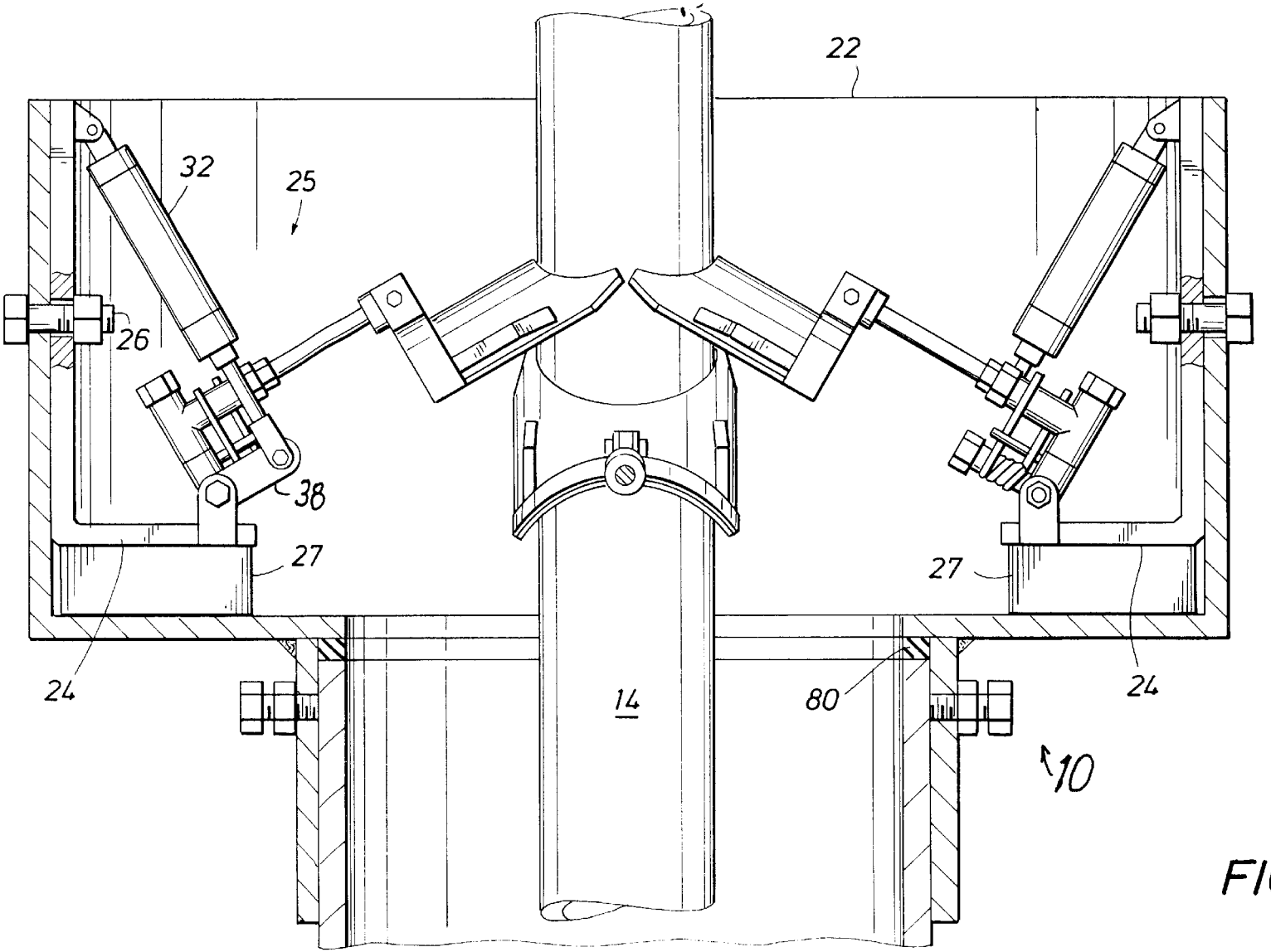
FIG. 2 is a sectional view showing the internal apparatus of the pipe wiping apparatus of the present disclosure incorporating evenly spaced actuators.

Attention is now directed to FIG. 2 of the drawings which shows the housing 22 to comprise a cylinder or octagon in the preferred embodiment. An L-shaped mounting bracket 24 mounts each of the several actuators. They are identical in construction and differ only in the relative position. As will be understood, the housing 22 has a circular opening through it so that the drill pipe can extend through the cabinet or housing 22. There are four actuators located at 90° spacing around the circle of the drill pipe. Four are used so that they can wipe the exterior surface with some measure of overlap. This assures that wiping can be accomplished easily in cleaning the drill pipe and protecting the rig floor.

The mounting bracket 24 is an L-shaped bracket which serves as an anchor for the equipment to be described. The mounting bracket 24 supports the actuator 25. The actuator is fastened to the housing by one or more mounting bolts 26. Each individual actuator is similar to the others and can be more readily understood on reference to FIG. 3 of the drawings. There, the mounting bracket 24 is shown bolted by the bolts 26 with the wiping element in the retracted position. Considering the structure of the actuator 25 shown in FIG. 3, the mounting bracket 25 supports a mounting tab 28 located at the top end. A clevis 30 anchors a pneumatic cylinder 32 at that location. The cylinder 32 encloses a piston 34 which connects with the piston rod 36. In the retracted position of FIG. 4, it is shown connected with a bell crank 38 at a pivot connection 40. The crank 38 extends downwardly and mounts on a shaft terminating in a bolt head 42. The shaft passes through a pair of upstanding spaced mounting lugs 44. The shaft of specified length is sufficiently long to support a sleeve 46 which has an extending center leg 48. The operation of the pneumatic cylinder 32 moves the crank 38. The crank 38 is pivoted around the shaft 42 and is, therefore, rotated by approximately 60 and 80° in contrast between FIGS. 3 and 9. The crank 38 rotates an elongate shaft 49 connected with a pair of mounting plates 52 which form a clamp on the wiper. The clamper plates 52 are all formed of metal and are bolted together by the bolt 54.

Figure 7:
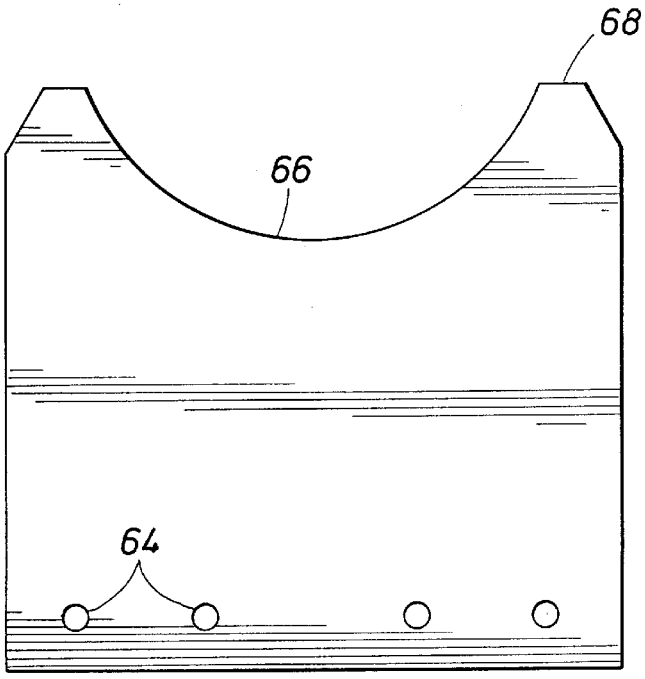
FIGS. 7 and 8 together jointly show the wiping element mounting clamp.
Figure 8:
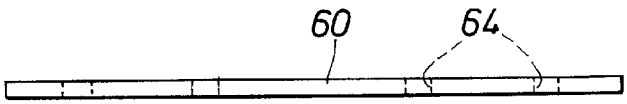
Figure 6:
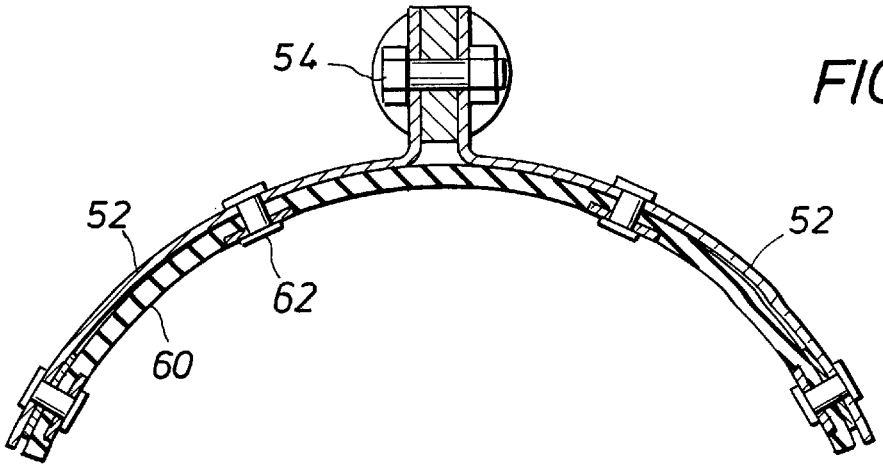

To complete the description of the wiping system which has been described in part, attention is momentarily directed to FIGS. 7 and 8 together. A rubber wiper 60 is shown in both views. The distal end is able to deflect depending on the stiffness of the rubber or resilient sheet to permit substantial flexure without breaking. As shown in FIG. 6, similar right and left clamps 52 terminate in upstanding tabs which are bolted together by a bolt 54. The bolt provides alignment for the upstanding tabs on the wiper clamps. The clamps 52 are constructed in a similar fashion and together provide symmetrical support for the wiper element 60. The wiper element 60 is pliable so that it will curve. A number of anchor bolts 62 fasten the wiper element holes 64.

Going now to FIGS. 6 and 7 jointly, the wiper element 60 is shown in detail. In the edge view of FIG. 6, it will be observed to have parallel faces, and it is constructed with a number of similar holes 64 which are matched in location to the mounting bolts 62 to anchor the wiper element firmly. It has a notched edge 66 which interrupts the extended edge 68 extended towards the pipe. The sheet of material is curved so that the end located curvature 66 fits around the pipe more readily. For that reason, the width of the wiper element and the profile of the curvature 66 are both tailored to a particular pipe size, or more accurately to a range of sizes. Indeed, the device can be used to wipe the exterior of production tubing, even tubing as small as 2.375". On the other hand, it is much more successful in wiping the exterior of conventional size drill pipe including drill pipe having nominal dimensions of 5 or 6". The curvature 66 is shaped so that wiping contact with the pipe is achieved over an included angle of about 100°.

Figure 3:
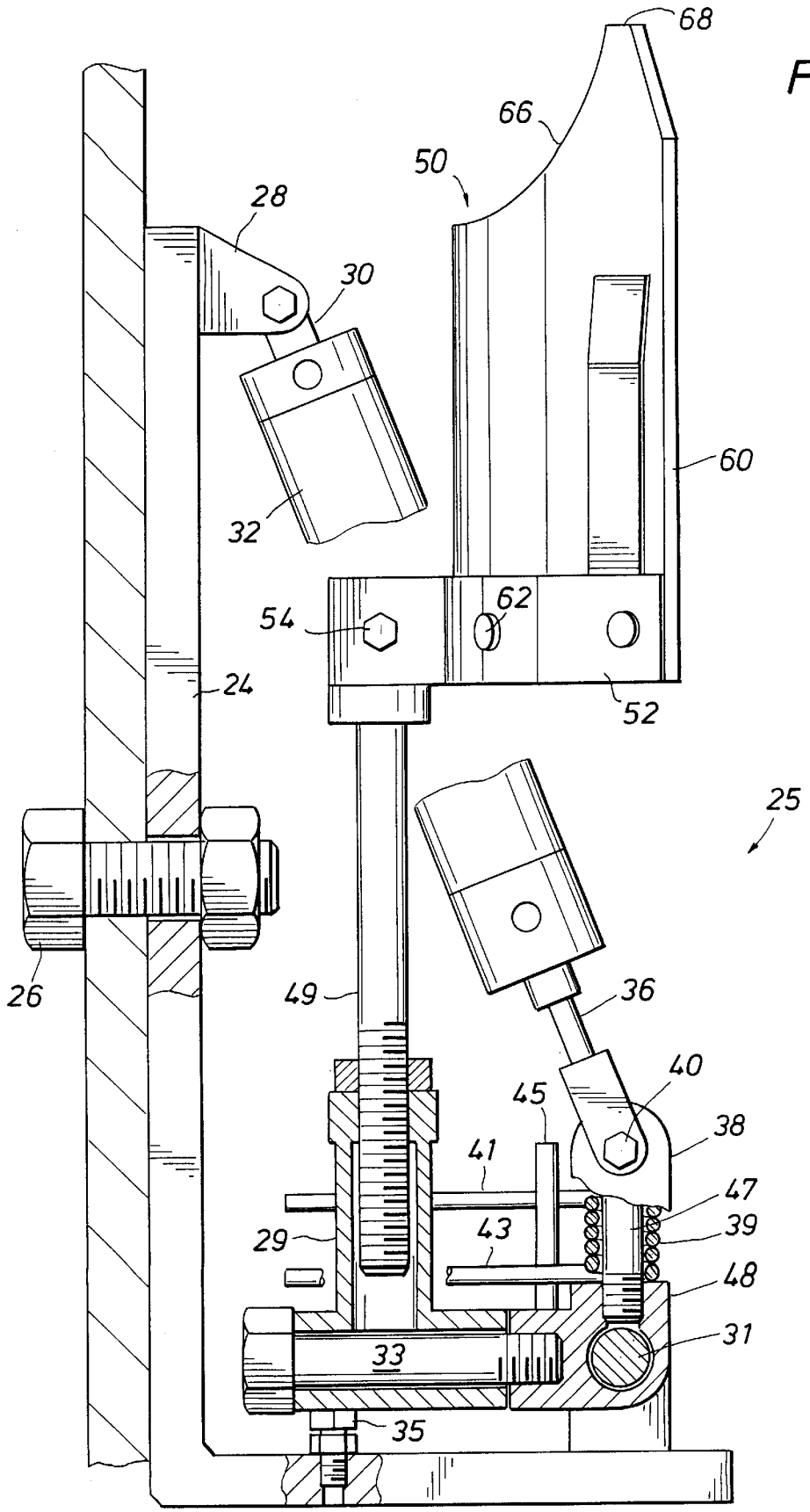
FIG. 3 of the drawings is a side view of an individual actuator in the retracted position showing the wiping element withdrawn from contact against the drill pipe.

FIG. 3 shows the curving edge 66 on the wiper element 60. The wiping element is made of resilient sheet material so that gentle contact can be made at the exterior over an included angle of about 100° to wipe drilling mud and cause it to flow downwardly on the exterior of the pipe. When an upset is encountered, or perhaps a crooked joint of pipe, the flexibility of the wiper element 60 permits easy passage.

The preferred form of wiper 60 utilizes a relatively soft rubber material which is typically provided with a hardness of only about 20 to 40 durometer. It is provided in sheet stock which is at least about ⅛" thick, and has a width which is sufficient to encompass or match the selected pipe size. Thus, the wiper is deployed subject to the curvature in the wiper 60 as a result of mounting on the wiper clamps 52.

Attention is now directed to FIG. 9 of the drawings which shows the pneumatic power system. An air pressure supply line 70 is connected with a controlled source of air (not shown) which is switched to extend the four actuators and thereby initiate pipe wiping. The air line is located on the interior of the housing 22 and extends fully around the interior. Preferably, the four cylinders are pneumatic in operation. They are preferably double acting cylinders which include high and low pressure sides.

In FIG. 9 of the drawings, an inflatable seal ring 80 is incorporated to assure a tight connection between the bell nipple and the housing 22. This firmly and snugly hold the present invention 10 to the mud return system. This is mounted easily by cutting the top end of the pipe flush to support the weight of the wiping device 10.

Each individual actuator is similar to the others and can be more readily understood on reference to FIGS. 2 and 3 of the drawings. FIG. 2 shows two opposing brackets raised on pedestals or mounting spacers 27 while the orthogonal pair are not elevated. The mounting bracket 24 is fixed in position by the bolts 26.

Figure 4:
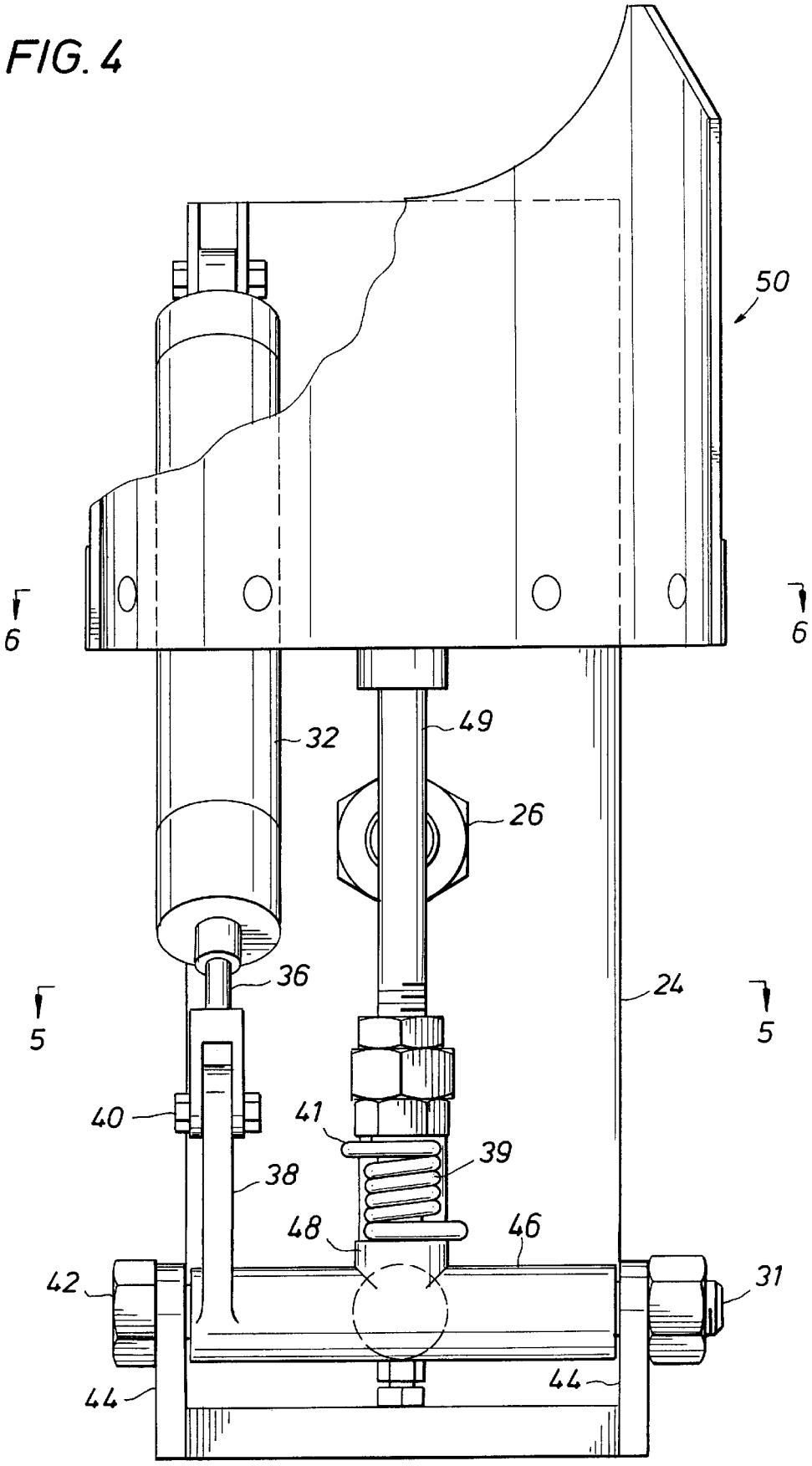
FIG. 4 is a view similar to FIG. 3 showing the wiping element extended so that contact is made with the pipe.

Viewing FIGS. 3 and 4 jointly, the pneumatic cylinder 32 extends the piston rod 36. This causes rotation around the shaft 31. The journalled sleeve 46 is caused to rotate as a result of the linkage to it through the bell crank 38. The bell crank provides rotation which, in theory, can approach about 90°; in actuality, approximately half that rotation is needed, and rotation beyond that does not serve any significant purpose. As reviewed, therefore, in FIG. 3 of the drawings, rotation about the shaft 31 prompts rotation of a tee 29 which is joined by a bolt 33 to the journalled sleeve 46. The tee 29 has an upstanding leg which supports a mounting shaft 49. By the use of many turns of threads on the shaft 49 and a suitable lock nut positioned around the shaft, the relative extent or length of the shaft 49 can be adjusted. Ultimately, adjustment at this location changes the length of the extended wiper element to be described. This changes the reach of the equipment when it rotates. As viewed in FIG. 3, it is retracted. As will be discussed later, it is able to extend as shown in FIG. 9. The locus of the pipe in FIG. 9 can vary dependent on pipe diameter and other factors. The extended mounting shaft 49 is therefore varied to enable the reach to be modified. This change in reach or extent is an adjustment which can be made for a given pipe size and later changed should the size of the drill pipe change. Drill pipe ranges from as much as 7" down to smaller diameters. It may be necessary to extend the wiper to contact even against tubing which is smaller than 3". Whatever the circumstances, adjustments in the threaded connection of the shaft 49 help accommodate changes of pipe size.

Figure 5:
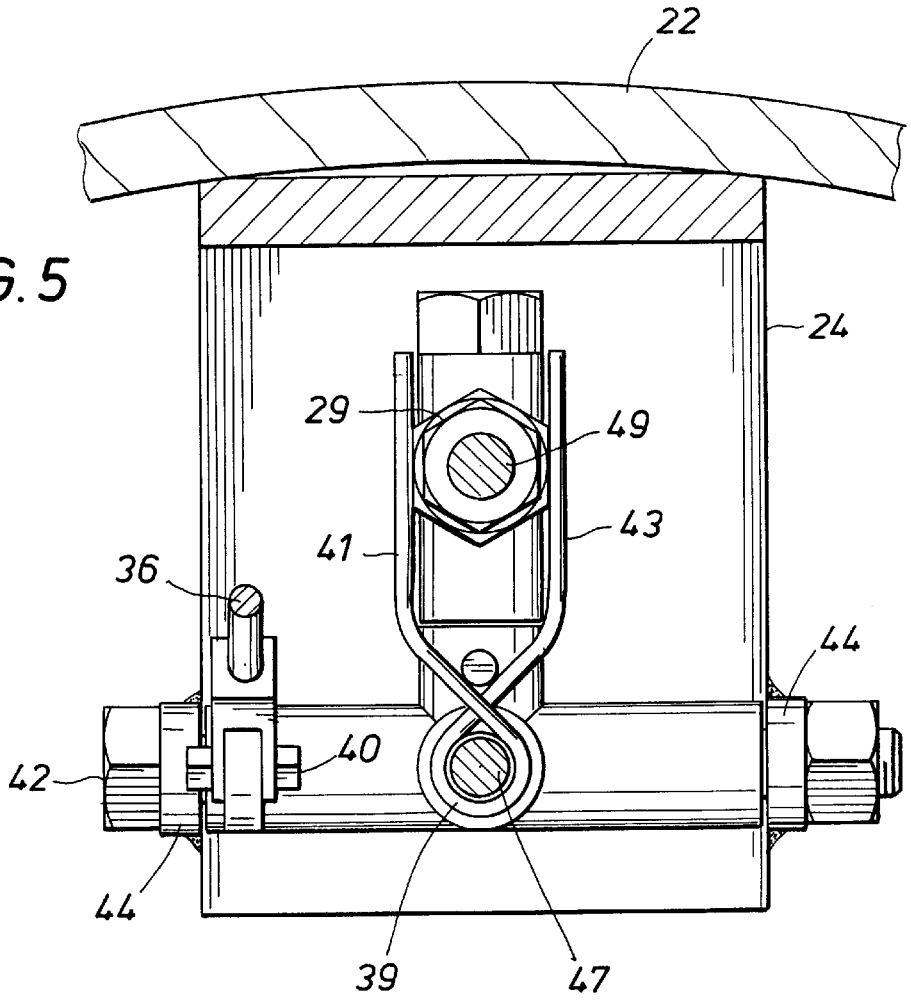
FIGS. 5 and 6 together show the wiping element which is a planar flexible sheet.

Continuing now with FIGS. 3 and 4, rotation to the retracted position is limited by a stop bolt 35. This is the beginning point of operation. As shown in FIG. 3, the shaft 49 is positioned where it is more or less vertical and is parallel to the mounting bracket 24. The tee 29 is located at the center of the journalled sleeve 46. This center location assists in centering the wiper element so that it moves along a radial line approaching the pipe, of course, assuming that the pipe is round and centralized in the conductor pipe below and the rotary table above. That is assumed to be the norm but reality suggests that the pipe maintain the centerline position, but departures from that will occur. Movement to the left or right from the centerline position of FIG. 4 may be required. Movement occurs by rotation around the mounting bolt 33 and the tee 29. This prompts the mounting shaft 49 to swing through a limited arc of perhaps 5° or 10° to the right or to the left as reviewed in FIG. 4. This mounting shaft 49 can swing to the left or right pivoting around the bolt 33 as noted. It is helpful, however, to restore it to the initial location. Restoration is accomplished by the spring 39 better shown in FIGS. 4 and 5 together. The spring includes several turns coiled in a circle and terminates in a pair of crossed legs. The legs 41 and 43 are crossed in FIG. 5 to bracket the mounting shaft 47 and clamp around the upper end of the tee 29 shown in side view in FIG. 3. The upper leg 41 in both FIGS. 3 and 4 will be observed spaced vertically above the leg 43. The vertical spacing is defined by the height of the coil spring 39. The legs are limited in their flexure by an upstanding alignment pin 45. The alignment pin is upright, and does not move to the left or right. The coil spring 39 is wound around an upstanding mounting post 47, see FIG. 5. The post 47 is the mount for positioning the circular turns of the coil spring 39 to assure that it is installed at the right location. The post 47 has a height to support the coil spring positioned around it. The post 47 is threaded at the lower end to thread into the centered leg 48 previously defined. In summary, the coil spring and post restore the shaft 49 to the desired centerline and vertical position shown in FIG. 4.

Consider, for the moment, operation of the equipment. The tee 29 is able to oscillate around the shaft 33. It is centered in FIG. 4 but deflects about 5° or 10° to the left or right. When that occurs, the spring 39 applies a force through either the leg 41 or the other leg 43 to restore the centerline position. While deflection is permitted, it occurs only so long as required. In turn, that is determined by the engagement of the wiper element to be described with the outside wall of the pipe. This mode of operation accomplishes all that is needed in following movement of the pipe dynamically during a actual drilling operation. Again, this occurs as a result of crooked pipe or pipe which is not necessarily round. The restoring force of the spring accomplishes restoration as desired.

FIG. 3 shows the equipment retracted so that no wiping occurs. For contrast, attention is now directed to FIG. 9 of the drawings where it is shown extended with the wiping element 60 contacting the pipe at a non perpendicular angle. The operation of the pneumatic cylinder 32 moves the crank 38. The crank 38 is pivoted around the shaft 42 and is, therefore, rotated by approximately 60 to 80° in contrast between FIGS. 3 and 4. When it rotates, it also rotates the clamp plate securing the spring blade 50. The crank 38 is attached for rotation with a pair of mounting plates 52 which form a clamp around the blade 50. The blade 50 and the clamp plates 52 are all formed of metal and are bolted together by bolts 54 to fasten the blade 50. It extends laterally in such a position that the wiping element is deployed for wiping.

Figure 10:
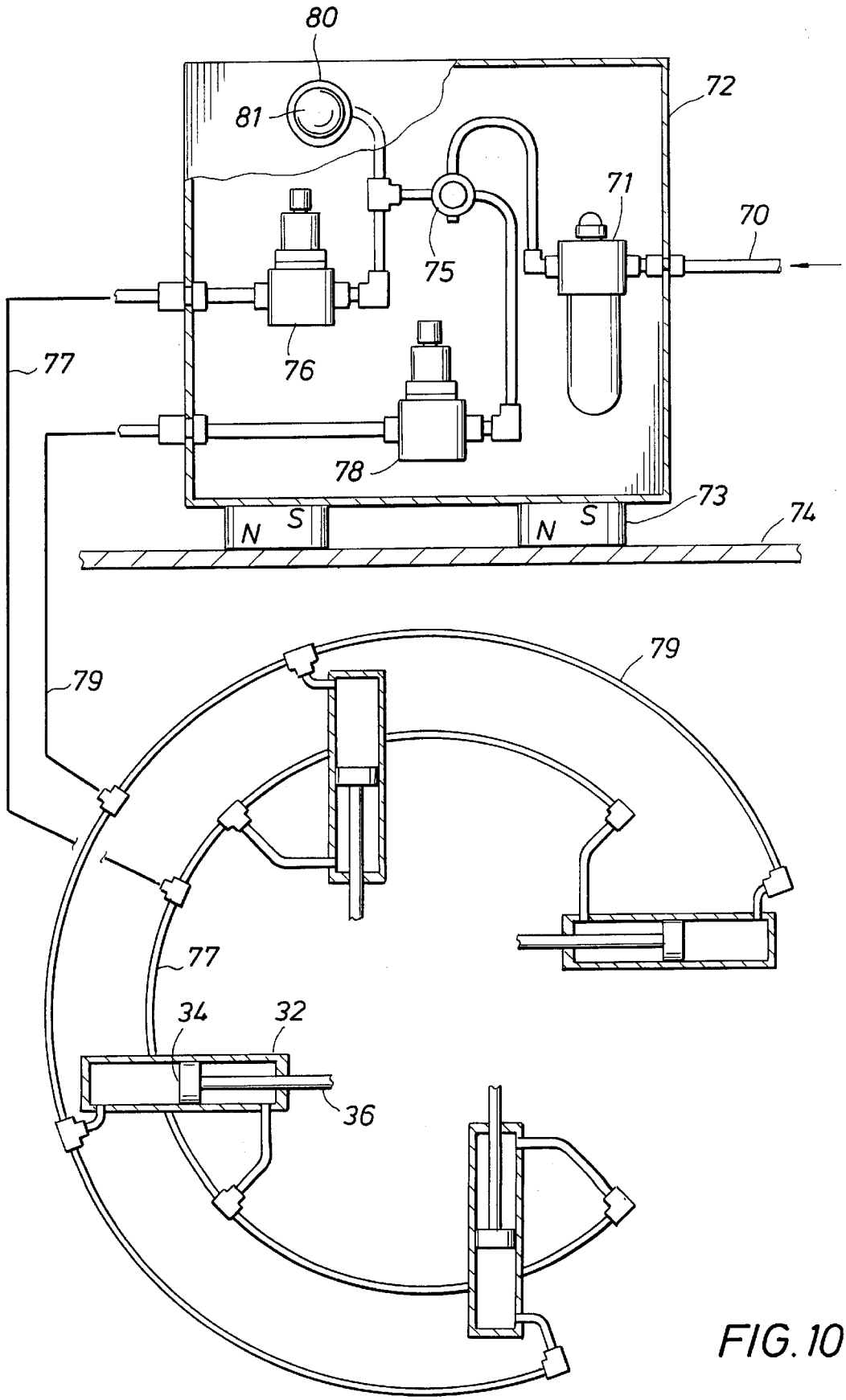
FIG. 10 is a schematic flow diagram for air pressure provided for operation of the system.

Attention is now directed to FIG. 10 of the drawings which shows the pneumatic power system. An air pressure supply line 70 is connected with a controlled source of air (not shown) which is switched to extend the four actuators and thereby initiate pipe wiping. The air line 70 is connected to a lubricator 71 mounted in a cabinet 72 which protects the air flow equipment from the weather. The cabinet 72 has attached, at the bottom, a set of magnets 73 which enable the cabinet 72 to be anchored temporarily in place on the steel deck plate 74. The drilling rig is normally formed with steel plates. Magnetic attachment serves to anchor the cabinet. The cabinet encloses the lubricator 71 which delivers air under pressure to a manifold 75, and that, in turn, delivers air under pressure to a regulator 76. The regulator 76 provides a regulated output pressure on a line 77 which extends to the interior of the cabinet 22. The line 77 extends in a circular path on the inside and connects with the four identical pneumatic cylinders 32. The cylinders 32 are preferably double acting so that the piston in each is driven positively in one direction and also positively driven in the opposite direction. There is another regular 78 in the cabinet. It provides air under pressure on the line 79 which connects to a similar parallel line 79 in the cabinet or housing 22. The lines 77 and 79 have branches as illustrated in FIG. 10 showing how they operate the four pneumatically powered cylinders in unison. They extend and retract together. Extension is obtained as illustrated in FIG. 9 by extending the piston rod 36. This requires an increase in pressure in the line 79. An increase in pressure in the line 77 signifies retraction. A dump valve is included at 80, and a movement indicator 81 extends, thereby providing a visual signal that the pressure status is readable from a distance. One or two such indicators can be included, perhaps marked with different colors to provide different indications. Without limiting the invention, color indications are used to provide appropriate signals to the driller. The driller operates the equipment from the rig floor and relies on the signals which provide a visible indication of the wipers even though they are located out of sight and their condition cannot be directly known. Generally, it is desirable that a positive signal be provided when the wipers are extended and contacted against the pipe as illustrated in FIG. 9. The wipers are extended, and that signal is formed to the driller.

The pressure of the two regulators should be noted. Pressure to extend is obtained through the line 79 which is provided through the regulator 78. Assume, for purposes of discussion, that pressure regulator is set at 50 psi. That is enough to overcome pressure through the regulator 76 which might be 20 psi. Other examples can be given for the two representative pressures. Suffice it to say, positive pneumatic pressure is applied in both extension and retraction conditions to assure positive action. The indicator 81 gives the driller the necessary signal. This deploys the air line 70 so that it connects with the four actuators. It is connected to extend the piston rods 36 as shown in FIGS. 3 and 4. Preferably, the four cylinders are pneumatic in operation. They are double acting cylinders which include a low pressure side. The exhaust line 77 is connected to the four cylinders. This, therefore, ties operation of the system to a single pneumatic signal, namely, the application of air to the supply line 70 under control of the operator.

In FIG. 9 of the drawings, an inflatable seal ring 80 is incorporated to assure a tight connection between the bell nipple and the housing 22. This firmly and snugly holds the present invention 10 to the mud return system. This is achieved easily by leveling the top end of the pipe flush to support the weight of the wiping device 10.

The wipers bear against the drill pipe with a force which is controlled by the pneumatic pressure applied to the system. As shown above, air is delivered to the pneumatic cylinders. Each pneumatic cylinder 32 has a specified piston diameter. They are preferably equal because they function in the same manner. With four pneumatic cylinders arranged in a circle around the drill pipe, each is provided with the same air pressure working against the same size piston. Since piston size is fixed with construction, pressure can be varied to thereby control the force. The wiping force applied at each wiper against the pipe is counteracted by the coil spring which tends to return the wiper to the retracted position. By properly balancing these two so that the pneumatic cylinder slightly overcomes the coil spring, a very light or delicate touch can be obtained. It is not necessary to bear had against the drill pipe. It is not necessary for effective cleaning. Proper wiping or cleaning is therefore obtained with the wipers inclined upwardly toward the pipe in the extended position, and the force on the wipers enables the wipers to easily deflect with crooked pipe or external upsets on the pipe. Every shoulder readily passes through the wipers.

While the foregoing is directed to the preferred embodiment, the scope thereof is determined by the claims which follow.

What is claimed is:

1. A pipe wiping apparatus comprising:

(a) a housing adapted to be positioned below a rig floor and axially aligned with the locus of a drill string extending through the rig floor so that pipe raised from the well below is wiped;

(b) at least a pair of similar actuators mounted in near proximity to the locus of the pipe wherein each of said actuators comprises:

(1) a powered member moving between an extended and retracted position;

(2) an extending arm moved thereby;

(3) a wiper mounting means on said arm;

(c) a pipe wiper formed of resilient material having an edge conformable to the arc of curvature of the side wall of the pipe so that the pipe is wiped thereby; and (d) wherein said actuator and the wiper mounting means position the pipe wiper at an angle so that external upsets in the pipe deflect said pipe wiper.

2. The apparatus of claim 1 wherein said pipe wiper is formed of sheet resilient material having an edge with a notch therein and said notch is contoured so that the notch conforms to the curvature of the pipe, and wherein said pipe wiper mounting means shapes said pipe wiper.

3. The apparatus of claim 1 wherein said actuator comprises a cylinder having a piston therein with an extending piston rod connected to said piston.

4. The apparatus of claim 1 wherein said extending arm comprises an elongate extendable arm having a near end and an extending arm end so and said arm is mounted to deflect laterally left and right.

5. The apparatus of claim 4 wherein said arm deflects vertically around a pivot connected to said powered member.

6. The apparatus of claim 5 wherein said wiper mounting means comprises a curving bracket shaping said wiper element into an arc.

7. The apparatus of claim 6 including means moving said actuator toward said retracted position.

8. The apparatus of claim 1 wherein said extending arm is mounted to pivot in two directions at right angles.

9. The apparatus of claim 8 wherein said pipe wiper is formed of sheet resilient material having an edge with a notch therein and said notch is contoured so that the notch conforms to the curvature of the pipe, and wherein said pipe wiper mounting means shapes said pipe wiper.

10. The apparatus of claim 8 wherein said actuator comprises a cylinder having a piston therein with an extending piston rod connected to said piston.

11. The apparatus of claim 8 wherein said extending arm comprises an elongate arm having a near end and an extending arm end mounted so that said extending arm end deflects laterally left and right.

12. The apparatus of claim 11 wherein said arm deflects vertically around a pivot connected to said powered member.

13. The apparatus of claim 12 wherein said wiper mounting means comprises a curving bracket shaping said wiper element into an arc.

14. The apparatus of claim 13 including means moving said arm actuator toward a centered position.

15. A pipe wiping mechanism comprising:

(a) a housing having a central passage therethrough to enable said housing to fit around a drill pipe to be wiped;

(b) first and second displaced actuators located in said housing so that wiping elements are extended radially toward a pipe to be wiped;

(c) a mounting arm supporting for each of said wiping elements pivotably movable between two positions wherein one position extends the wiping element for contact at an angle of inclination with respect to said pipe, and also movable to a second position retracted from contact against said pipe and said angle of inclination is non-perpendicular with respect to said pipe.

16. An external pipe wiping apparatus comprising:

(a) a housing having an axial passage therethrough to enable said housing to be positioned under a drilling rig floor and to enable a pipe string to extend through said housing for wiping of the exterior surface of pipe when the pipe string is raised;

(b) at least three similar wiper actuators mounted around said housing and positioned evenly with respect to angular deployment with respect to said housing and pipe;

(c) a wiper element for each actuator having a profiled side for contact against a pipe wherein said wiper elements are mounted on said wiper actuators; and (d) a pivot in each of said actuators providing pivotal movement to said wiper elements so that said wiper elements move in an arc radially toward said pipe and away from said pipe and the arc of movement is away from said pipe for retraction and is radially inwardly toward said pipe for positioning in contact with said pipe.

17. The apparatus of claim 16 wherein said pivots define a horizontal axis of rotation and said pivots support said wipers on arms extending upwardly to move in arc in a plane common to said pipe.

18. The apparatus of claim 17 wherein said actuators are mounted fully inside said housing.

19. The apparatus of claim 16 wherein each of said actuators comprises means moving said wipers away from said pipe, and said actuators also include a powered piston moving said wiper toward said pipe.

20. The apparatus of claim 19 wherein said pivots include:

(a) a pair of mounting tabs;

(b) a shaft mounted between said tabs;

(c) an extending arm mounted for rotation toward said pipe and mounted on said shaft;

(d) a coiled spring to apply a bias force against said arm; and (e) a cylinder for said piston to move said arm and wiper.

21. The apparatus of claim 16 wherein each of said actuators connects to an extending arm pivotally mounted for rotation in two orthogonal directions.

22. The apparatus of claim 21 wherein said pivots define a horizontal axis of rotation and said pivots support said wipers on arms extending upwardly to move in arc in a plane common to said pipe.

23. The apparatus of claim 22 wherein said actuators are mounted fully inside said housing.

24. The apparatus of claim 16 wherein each of said actuators supports a yieldable coil spring moving said wipers toward a reference position, and said actuators also include a powered piston moving said wiper toward said pipe.

25. The apparatus of claim 24 wherein said pivots include:

(a) a pair of mounting tabs;

(b) a shaft mounted between said tabs;

(c) an extending arm mounted for rotation toward said pipe and mounted on said shaft;

(d) said spring is coiled around said arm to apply a bias force for said arm; and (e) a cylinder for said piston to move said arm and wiper.

26. A method of pulling a pipe string and wiping said string during pulling comprising the steps of:

(a) positioning a wiper against an arcuate side of the pipe during pulling;

(b) fluidically forcing the wiper toward the pipe with a first force;

(c) applying a second force to the wiper to retract the wiper from the pipe wherein the second force is less than the first force; and (d) periodically interrupting the fluidically generated force so that said first force is interrupted and said wiper is moved to a retracted location out of contact with said pipe.

27. The method of claim 6 wherein said fluidically generated force is formed by applying a pneumatic force against a piston in a cylinder.

28. The method of claim 26 wherein said second force is formed by a coiled spring.

29. The method of claim 28 wherein said forces are torsional and cause rotation of said wiper.

30. The method of claim 29 wherein said coil spring force is constantly applied.

* * * * *